United States Patent [19]

Favre et al.

[11] 4,258,427

[45] Mar. 24, 1981

[54] ISOTOPE ANALYSIS

[75] Inventors: John A. Favre; Thomas W. Schmidt, both of Bartlesville, Okla.

[73] Assignee: Phillips Petroleum Company, Bartlesville, Okla.

[21] Appl. No.: 30,988

[22] Filed: Apr. 18, 1979

[51] Int. Cl.[3] ..... H01J 39/34

[52] U.S. Cl. ..... 364/527; 250/281; 250/514; 364/499

[58] Field of Search ..... 364/497–499, 364/527, 524, 570; 250/281–286, 514; 324/300, 307, 308

[56] References Cited

U.S. PATENT DOCUMENTS

| | | | |
|---|---|---|---|
| 2,652,495 | 9/1953 | Washburn | 250/281 |
| 2,905,821 | 9/1959 | Younkin | 364/498 |
| 2,953,680 | 9/1960 | Robinson | 250/286 |
| 3,818,197 | 6/1974 | Piccolo et al. | 364/498 |
| 3,924,124 | 12/1975 | Favre et al. | 250/281 |
| 4,031,397 | 6/1977 | Cardillo | 250/281 |
| 4,068,122 | 1/1978 | Schmidt et al. | 250/281 |
| 4,167,668 | 9/1979 | Mourier | 250/281 |

OTHER PUBLICATIONS

Sa, A de et al., "An Inexpensive Digital Method for the Measurement of Isotope Ratios," Journal of Physics E, Scientific Instr., vol. 5, pp. 138–149, 1972.

McKinney et al., "Improvements in Mass Spectrometers for the Measurement of Small Differences in Isotope Abundance Ratios," Rev. of Sci. Instr., vol. 21, No. 8, pp. 724–730, 1958.

Hoefs, "Stable Isotope Geochemistry," Isotopes in Geology, pp. 10–18, 1973.

*Primary Examiner*—Errol A. Krass

[57] ABSTRACT

The difference in concentration of a selected isotope in two materials is measured by directing gaseous beams of the materials towards the inlet of a mass spectrometer. A shutter alternately blocks transmission of the two beams. Means is also provided for blocking either of the two beams for any period of time desired. Provision is made for automatically passing either one of the gaseous beams or both of the gaseous beams through the shutter to the mass spectrometer. The output signal from the mass spectrometer is passed to a synchronous detector as is a reference signal which is representative of the speed of operation of the shutter. The output signal from the synchronous detector is representative of the concentration of the selected isotope in a first material if only the gaseous beam of the first material is being passed through the shutter to the mass spectrometer. The output signal from the synchronous detector is representative of the concentration of the selected isotope in the second material if only the gaseous beam of the second material is being passed through the shutter to the mass spectrometer. The output signal from the synchronous detector is representative of the difference in concentration of a selected isotope in the two materials if both of the gaseous beams are being passed through the shutter alternately to the mass spectrometer. If desired, these outputs may be utilized to calculate the isotope ratio difference (δ) for the selected isotope in the two materials.

11 Claims, 3 Drawing Figures

ISOTOPE ANALYSIS

This invention relates to isotope analysis. In a particular aspect this invention relates to a method and apparatus for measuring the differences in the concentration of a selected isotope in two materials. In another particular aspect this invention relates to a method and apparatus for making fast, accurate measurements of the differences in the concentration of a selected isotope in two materials. In still another particular aspect this invention relates to a method and apparatus for measuring the isotope ratio difference (δ) for a selected isotope in two materials.

It is often desirable to measure differences in the concentration of a selected isotope in two materials. For example, such a procedure can be used as an aid in determining if petroleum samples derived from two different wells came from a common reservoir. U.S. Pat. No. 3,924,124 describes a system for measuring the differences in the concentration of the selected isotopes in two materials. However, it is very difficult to make a fast analysis using the apparatus described in U.S. Pat. No. 3,924,124 and it is particularly difficult to make a plurality of identical measurements very quickly, which is desirable in measuring differences in the concentration of a selected isotope in two materials.

There are two basic reasons why it is desirable to be able to make the measurements very quickly. In many cases, only a very small sample of either one or both of the materials is available. If the measurements cannot be made quickly, sufficient sample may not be available to complete the desired measurements. Also, it is often desirable to obtain a plurality of measurements for the same selected isotope in two materials to improve the reliability of the measurements. However, the plurality of measurements must be made very quickly to avoid changes which may be caused by changes in temperature, drift of amplifiers or other similar factors.

It is thus an object of this invention to provide an improved dual beam mass spectrometer system which will allow faster more accurate measurements of the differences in the concentration of a selected isotope in two materials.

It is common in the art of isotope analysis to refer to isotope ratio differences. It is thus another object of this invention to provide method and apparatus for converting the measurement of the difference in the concentration of a selected isotope in two materials into an isotope ratio difference measurement.

In accordance with the present invention, molecular beams are formed from two materials and these two molecular beams are directed in separate paths towards the inlet of a mass spectrometer which is set to measure a selected isotope. A shutter is positioned in the path of each of the two molecular beams and actuated so that the beams are alternately transmitted through the shutter to the inlet of the mass spectrometer. Means is also provided for blocking either one or both of the two molecular beams for a desired period of time. The output signal from the mass spectrometer together with a reference signal, which is representative of the frequency at which the two molecular beams are being alternately transmitted to the mass spectrometer, are applied to a synchronous detector which establishes a single output signal representative of the difference in the concentration of the selected isotope in the two materials if both molecular beams are being passed through the shutter to the inlet of the mass spectrometer. The sequential operation of the above described apparatus is controlled automatically so as to provide faster, more accurate measurements than are possible with the apparatus of U.S. Pat. No. 3,924,124.

Two sample materials may be compared directly and the output from the differential amplifier will be representative of the difference in the concentration of a selected isotope in the two sample materials. If desired, the two sample materials may be compared to a reference material having a known concentration of a selected isotope. In this manner, both the difference in the concentration of a selected isotope in the two sample materials and a quantitative measurement of the concentration of the isotope of interest in the two sample materials may be obtained.

The output signal from the synchronous detector is representative of the concentration of the selected isotope in the first material if only the gaseous beam of the first material is being passed through the shutter to the mass spectrometer. The output signal from the synchronous detector is representative of the concentration of the selected isotope in the second material if only the gaseous beam of the second material is being passed through the shutter to the mass spectrometer. These two signals, together with the output representative of the difference in the concentration of the selected isotope in the two materials, are utilized to calculate the isotope ratio difference for the selected isotope in the two materials based on the following equations.

The equation defining the isotope ratio difference (δ) is $$\delta = \left[ \frac{\frac{B_S}{A_S} - \frac{B_R}{A_R}}{\frac{B_R}{A_R}} \right] \times 1000 \qquad \text{(I)}$$

where

A and B are the concentration of two isotopes and the subscripts "S" and "R" refer to the sample and reference gases respectively. In the present technique for determining the isotope ratio difference, the intensity of the two beams reaching the mass spectrometer must first be balanced. The balance can be made while monitoring the mass of the most abundant isotope in the material and detecting the beam concentration difference on the phase sensitive detector output. When balanced, the concentrations of the most abundant mass in each beam reaching the mass spectrometer are equal. Thus, $A_S = A_R$ and equation (I) becomes $$\delta = \frac{B_S - B_R}{B_R} \times 1000 \qquad \text{(II)}$$

Two quantities are required to obtain a value for δ using the present method. The first is the magnitude of the concentration difference between minor components of the two molecular beams and the second is the magnitude of the minor component concentration in the reference beam. The value for the difference is obtained when both beams are allowed to reach the mass spectrometer alternately. The reference beam concentration is determined by blocking the path of the sample beam. The value for δ is obtained by dividing the concentration difference result by the reference beam concentration result and is expressed mathematically as $$\delta = \frac{V_B K_B}{V_{B'} K_{B'}} \times 1000 \quad \text{(III)}$$

where $V_B$ and $K_B$ are the output voltage and gain respectively of the phase sensitive detector for mass B when both beams reach the mass spectrometer alternately, $V_{B'}$ and $K_{B'}$ are corresponding values when only the reference beam is being detected, and the constant (1000) is utilized to convert to parts per thousand.

Other objects and advantages of the invention will be apparent from the foregoing description of the invention and from the claims as well as from the detailed description of the drawings in which:

The present invention is described in terms of specific apparatus for introducing two molecular beams into a mass spectrometer. The invention is, however, applicable to different apparatus configurations for introducing two molecular beams into a mass spectrometer.

Figures 1, 2:
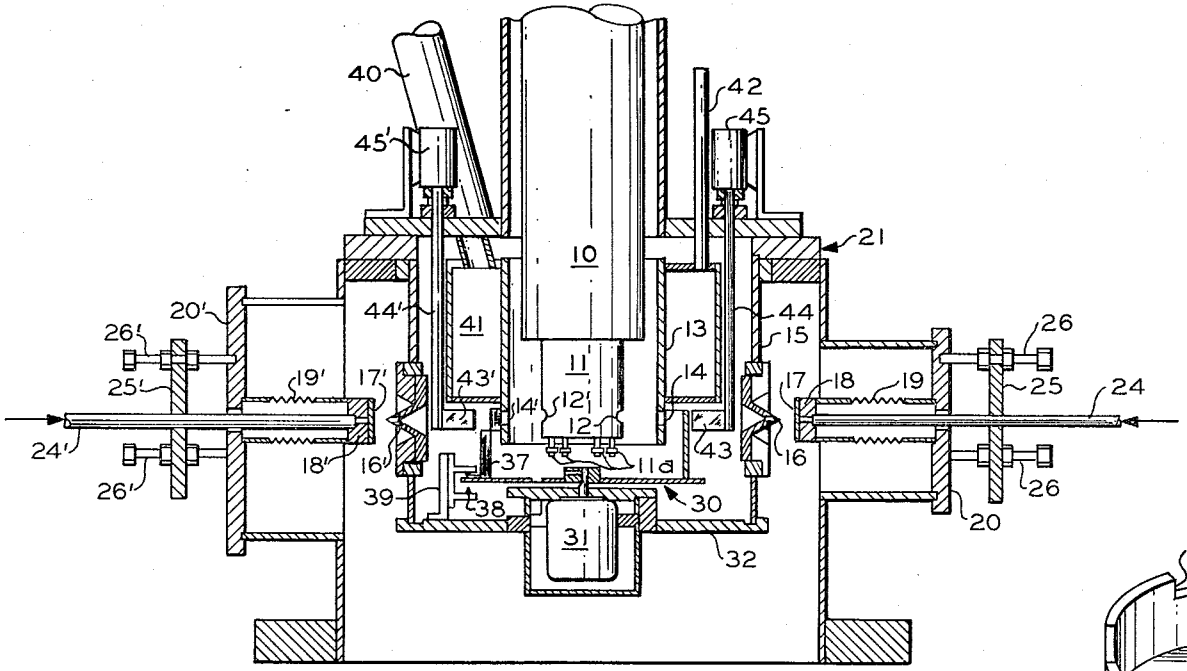
FIG. 1 is a view, shown partially in section, of the apparatus utilized in the present invention to introduce the two molecular beams into the mass spectrometer.
FIG. 2 illustrates the shutter employed in the apparatus of FIG. 1.

Referring now to the drawings in detail, and to FIG. 1 in particular, there is shown a mass spectrometer 10 having a sample inlet section 11. The mass spectrometer 10 is preferably an Extranuclear Model 324-9 quadrupole mass spectrometer equipped with a cross-axis ionizer. Inlet section 11 is provided with a first opening 12 through which a molecular beam can be introduced into the ionization chamber of the mass spectrometer. Inlet section 11 is surrounded by a sleeve 13 which has an opening 14 therein in alignment with opening 12. Sleeve 13 is surrounded by a sleeve 15 which supports a conical member 16. A small hole is formed in the tip of member 16, which hole can be of a diameter of the order of 0.381 to 0.762 mm, for example. A plate 17, which has a central opening therein, is attached to an annular member 18 which is supported by a bellows 19 that extends from a plate 20. The central opening in plate 17 can have a diameter of the order of 0.025 to 0.152 mm, for example. Plate 20 is secured to a housing 21 which supports the mass spectrometer and the elements thus far described. A tube 24 extends from member 18 through a plate 25 to which it is attached. Plate 25 is secured to plate 20 by a plurality of adjusting screws 26.

A sample of a first gas to be analyzed is supplied by tube 24. A molecular beam of this gas passes through the opening in plate 17, the opening in the tip of cone 16, and openings 14 and 12 to enter the inlet section of mass spectrometer 10. Adjusting screws 26 permit tube 24 to be aligned so that a narrow beam can pass through the small opening in cone 16.

Inlet section 11 of the mass spectrometer is provided with a second opening 12' on the opposite side from opening 12. Additional elements corresponding to those thus far described are located on this side of the instrument and are designated by corresponding primed reference numerals. These additional elements permit a sample of a second gas to be introduced though tube 24' to enter opening 12' in inlet section 11.

A shutter 30 is rotated by a motor 31 which is supported by a plate 32 that extends across the bottom of sleeve 15. Shutter 30 is illustrated in detail in FIG. 2 as comprising a disk 33 having a sleeve 34 extending upwardly therefrom. Disk 33 is provided with three openings 35 in the periphery thereof, and sleeve 34 is provided with three openings 36. As illustrated, the openings 35 and 36 are offset and are equally spaced with each extending approximately 60° about the circular shutter. Thus, openings 36 permit molecular beams to be transmitted alternately through openings 14 and 14'. Shutter 30 can be rotated at a speed of 10 to 30 revolutions per second, for example.

A light source 37 and a photocell detector 38 are mounted by a bracket 39, as shown in FIG. 1, so that light is transmitted from source 37 to detector 38 when one of the slots 35 of shutter 30 appears between the two elements. The output signal from detector 38 thus comprises a series of pulses at a frequency corresponding to the frequency at which the molecular beams are alternately transmitted to the mass spectrometer.

The apparatus of FIG. 1 is normally maintained at a relatively low pressure. The gas sample can be introduced through tube 24 at a pressure approximately atmospheric. However, pressures considerably above and below atmospheric can be employed if desired. The interior of housing 21 outside sleeve 15 and plate 32 is connected to a vacuum pump, not shown, so as to reduce the pressure to a value which is generally in the range of 0.133 to $1.33\times10^{-5}$ Pa. The interior of sleeve 15 can be connected to a vacuum pump, not shown, to reduce the pressure to a value in the general range of $1.33\times10^{-3}$ to $1.33\times10^{-6}$ Pa. A coolant, such as liquid nitrogen, can be introduced through a conduit 40 into a chamber 41 which surrounds sleeve 13. This coolant is vented through a conduit 42. A rotatable plate 43 is mounted on a rod 44 which is connected to a stepping motor 45 so that the beam entering through cone 16 can be blocked if desired. A similar plate 43', mounted on rod 44' which is connected to stepping motor 45', can be positioned in the beam which enters through cone 16'. The plates 43 and 43' are termed beam blocking plates hereinafter. The beam blocking plates 43 and 43' are said to be in an open position if the respective beams are not being blocked and are said to be in a closed position if the respective beams are being blocked. Electrical leads to the mass spectrometer can be attached to a series of terminals **11*a***.

The stepping motors 45 and 45' are preferably the HS25 stepping motor manufactured by Superior Electric Corporation. If desired, different types of motors could be utilized or a solenoid or other means for rotating a rod could be utilized in the present invention. The means for rotating the rods 44 and 44' need only be capable of rotating the plates 43 and 43' from a first position to a second position and then back to a first position in response to an electrical signal.

Figure 3:
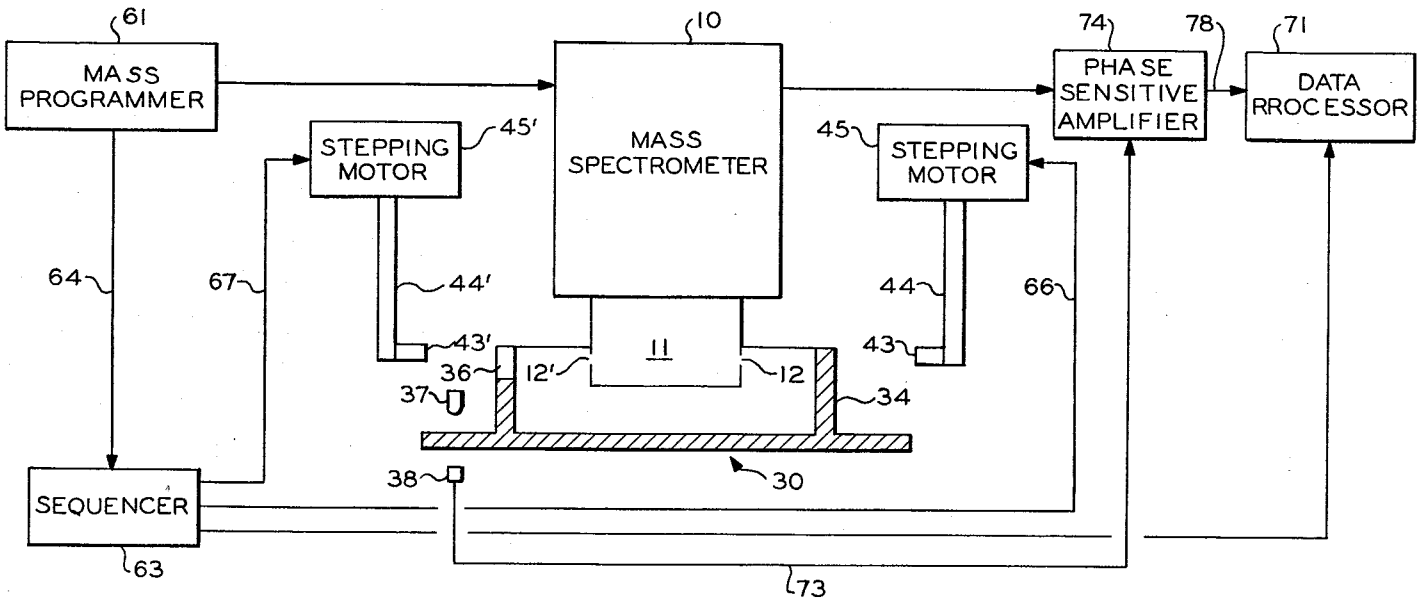
FIG. 3 is a block diagram of the isotope ratio difference measurements system of the present invention.

As is illustrated in FIG. 3, the mass spectrometer 10 is controlled by a mass programmer 61 which is preferably the Model 091-3 Mass Programmer manufactured by Extranuclear Laboratories, Inc. The mass spectrometer 10 and the mass programmer 61 are built as a functional unit by Extranuclear Laboratories, Inc. and function in a standard manner. The mass programmer 61 provides a means for setting the mass which will be accepted by the mass spectrometer 10 and also provides a means for providing sweep voltages to the ion current collector plates of the mass spectrometer 10.

At the initiation of a sweep period, the mass programmer 61 provides a triggering pulse to the sequencer 63 by means of the electrical conductor 64. The sequencer 63 is preferably the 5TI Programmable Control System manufactured by Texas Instruments, Inc. The 5TI Programmable Control System includes a sequencer, programmer and input and output modules. The operation of the 5TI Programmable Control System is fully set forth in the brochure entitled "Meet the 5TI Programmable Control System," Texas Instruments, Inc., November, 1977. In response to the triggering pulse, the sequencer 63 provides programmed stepping pulses to the stepping motors 45 and 45' via electrical conductors 66 and 67 respectively. In response to the stepping pulses, the stepping motors 45 and 45' rotate the rods 44 and 44' to either block or transmit the reference and sample molecular beams as desired. The sequencer 63 simultaneously provides an enabling pulse to the data processor 71 via the electrical conductor 73. The enabling pulse causes the data processor 71 to begin accepting analog data from the phase sensitive amplifier 74. The data processor 71 is a preferably an HP9854A manufactured by Hewlett Packard Corporation. The phase sensitive amplifier 74 is preferably a Model 5204 manufactured by Princeton Applied Corporation.

In operation, the mass spectrometer 10 is set to measure a desired isotope by the mass programmer 61. If the two samples being compared contain the same amount of this isotope, the output signal from the mass spectrometer is constant because the two samples are alternately received. However, a square wave output signal is obtained from the mass spectrometer if one of the samples contains a greater concentration of the isotope than the other. The phase sensitive amplifier 74 serves to amplify the signal which is in phase with the reference signal established by the detector 38. The output signal 78 from the phase sensitive amplifier 74 is essentially equal to the integral of the amplified square wave signal from the mass spectrometer 10. The amplitude of the output signal 78 which is supplied from the phase sensitive amplifier 74 to the data processor 71 is representative of the difference in concentration of the selected isotope in the two samples.

The following example is presented to more fully illustrate the present invention.

EXAMPLE

A sample of carbon dioxide gas is obtained from two different wells. The carbon dioxide gas will be primarily made up of carbon 12 with only trace amounts on the order of 100 parts per million of carbon 13. Carbon dioxide molecules containing carbon 12 will have a mass number of 44. Carbon dioxide molecules containing carbon 13 will have a mass number of 45.

As has been previously stated, the two samples of carbon dioxide gas could be compared directly to each other to determine if there is a difference in the concentration of an isotope of interest (carbon 13) in the two samples of carbon dioxide gas. This could be accomplished simply by injecting the two samples alternately into the mass spectrometer and noting the output from the phase sensitive amplifier. However, it is preferred to compare each sample to a reference gas having a known concentration of carbon 13. In this manner, the difference in the isotope concentration in the two carbon dioxide samples can be obtained and also the concentration of carbon 13 in the two carbon dioxide samples can be calculated.

An operational sequence for comparing two gas samples is set forth in Table I.

TABLE I

| Step | Beam Blocking Plate Position Ref. | Sample | Beam Gas to Mass Spectrometer | Mass Spectrometer Mass Number |
|---|---|---|---|---|
| 1 | Open | Closed | Ref. | 44 |
| 2 | Open | Open | Ref. & Sample | 45 |
| 3 | Closed | Open | Sample | 44 |
| 4 | Closed | Open | Sample | 45 |
| 5 | Open | Open | Ref. & Sample | 44 |
| 6 | Open | Closed | Ref. | 45 |

Before the operational sequence is begun, one of the samples is supplied to both of the inlets 12 and 12' illustrated in FIG. 1. The intensity of the two beams is balanced with the mass spectrometer being set to a mass number of 44. The mass spectrometer is set to a mass number of 44 because carbon 12 is the predominant isotope in the carbon dioxide gas. Balance is accomplished by adjustments such as changing the flow rate of the gases or other similar adjustments. The balance is made for monitoring the mass of the most abundant isotope (carbon 12) and detecting the beam concentration difference on the phase sensitive detector output. When balanced, the concentrations of the most abundant mass in each beam reaching the mass spectrometer are equal. Under these conditions, the isotope ratio difference can be determined from the concentration difference of the less abundant isotope (carbon 13) in the two beams as has been previously stated.

Referring now to Table I, in step 1 the reference beam blocking plate is open and the sample beam blocking plate is closed so as to block the flow of the sample molecular beam to the inlet of the mass spectrometer. The mass programmer sets the mass spectrometer to a mass number of 44 and also sets the sweep time for the mass spectrometer. The sweep time may vary from 3 to 1000 milliseconds or longer as desired. A preferred sweep time is on the order of 200 milliseconds. Each of the steps 1–6 occur in a time sequence. The period of each step may range from about 1 second to about 5 seconds although other time periods could be utilized if desired. If a step period of 1 second is selected, then 5 measurements are obtained from the mass spectrometer during each step because the sweep time is 200 milliseconds. Each measurement is provided to the phase sensitive amplifier 74 and the output signal 78 from the phase sensitive amplifier is supplied to the data processor 71. The data processor 71 averages the 5 measured values and stores the average value. During the second step both the reference and the sample molecular beams are provided to the mass spectrometer and the mass programmer sets the mass spectrometer to a mass number of 45. Again the sweep time is 200 milliseconds and the period of step 2 is 1 second. Thus again, 5 measurements are obtained and these 5 measurements are averaged and the result is stored by the data processor 71. This procedure is continued until the 6 steps have been completed and then the 6 steps are repeated as often as desired to provide a plurality of average measured values. The values for R44 and S44 and the value for R44–S44 are utilized to assure that the intensity of the two molecular beams has been balanced. The measurement for R45–S45 and R45 is utilized in equation 3 to calculate the isotope ratio difference. The value for S45 provides another comparison of the sample of the reference molecular beams. Since the concentration of carbon 13 in the reference gas is known, the data processor 71 prints out the measured values and also calculates the concentration of carbon 13 in the sample based on the known concentration of carbon 13 in the reference and the measured difference between the concentration of carbon 13 in the sample and the concentration of carbon 13 in the reference. This procedure can then be repeated for the second sample of carbon dioxide gas and in this manner both a qualitative and quantitative measurement of the difference in the concentration of carbon 13 in the two carbon dioxide samples can be obtained.

The beam blocking plate position is set automatically by the sequencer 63 which also provides an enabling signal to the data processor 71. This automatic control of the beam blocking plates and the automatic enabling of the data processor providing means by which very fast measurements can be made and very repeatable measurements can be made. High speed measurements are extremely desirable because often only a small amount of one of the two samples will be available and also because if measurements are made over a long period of time temperature variations or other similar variations may cause drift of the phase sensitive amplifier or other similar problems which will affect the repeatability and reproducibility of the measurements thus affecting the reliability and condifence in the final measurements.

The invention has been described in terms of specific apparatus and has also been described in terms of specific control apparatus for which the model numbers and manufacturers have been specified. The invention is not limited to the specific apparatus and is also not limited to the specific control apparatus listed. A plurality of manufacturers provide similar control equipment and different types of apparatus for introducing two molecular beams into a mass spectrometer alternately could be utilized if desired.

While the invention has been described in terms of the presently preferred embodiment, reasonable variations and modifiations are possible by those skilled in the art, within the scope of the described invention and the appended claims.

That which is claimed is:

1. Apparatus comprising:

a mass spectrometer having an inlet;

means for directing a first molecular beam formed from the vapor associated with a first material toward the inlet of said mass spectrometer at a time T;

means for directing a second molecular beam formed from the vapor associated with a second material toward the inlet of said mass spectrometer at said time T;

shutter means positioned so as to intersect said first molecular beam and said second molecular beam;

means for actuating said shutter means so that said first molecular beam and said second molecular beam are passed to the inlet of said mass spectrometer alternately;

first beam blocking means for blocking said first molecular beam;

means for moving said first beam blocking means into or out of the path of said first molecular beam;

second beam blocking means for blocking said second molecular beam;

means for moving said second beam blocking means into or out of the path of said second molecular beam;

means for initiating a sweep period for said mass spectrometer;

sequencer means;

means for initiating the operation of said sequencer means when a sweep period is initiated for said mass spectrometer, said sequencer means automatically controlling said means for moving said first beam blocking means and said means for moving said second beam blocking means so as to alternately pass or block either said first molecular beam or said second molecular beam or both said first molecular beam and said second molecular beam;

a phase sensitive detector means;

means for supplying the output signal from said mass spectrometer to said phase sensitive detector means;

means, responsive to said means for actuating said shutter means, for establishing a reference signal having a frequency corresponding to the frequency at which said first molecular beam and said molecular beam are alternately passed to the inlet of said mass spectrometer; and means for supplying said reference signal to said phase sensitive detector means, said phase sensitive detector means supply a first signal representative of the difference in the concentration of a selected isotope in said first material and the concentration of said selected isotope in said second material when both said first molecular beam and said second molecular beam are passed alternately to the inlet of said mass spectrometer, said phase sensitive detector means supplying a second signal representative of the concentration of said selected isotope in said first material when only said first molecular beam is being passed to the inlet of said mass spectrometer, said phase sensitive detector means supplying a third signal representative of the concentration of said selected isotope in said second material when said first molecular beam is blocked and only said second molecular beam is being passed to the inlet of said mass spectrometer.

2. Apparatus in accordance with claim 1 wherein said first molecular beam is formed from a reference material having a known concentration of said isotope and said second molecular beam is formed from a sample material having an unknown concentration of said isotope.

3. Apparatus in accordance with claim 2 additionally comprising:

data processor means;

means for supplying the output of said phase sensitive detector to said data processor means, said sequencer means providing an enabling signal to said data processor means to enable said data processor means to accept data from said phase sensitive detector means when a sweep period is initiated for said mass spectrometer.

4. Apparatus in accordance with claim 2 additionally comprising:

means for establishing a fourth signal representative of the gain of said phase sensitive detector means when both said first molecular beam and said second molecular beam are transmitted alternately to the inlet of said mass spectrometer;

means for multiplying said first signal by said fourth signal to establish a fifth signal;

means for establishing a sixth signal representative of the gain of said phase sensitive detector means when said second molecular beam is blocked and only said first molecular beam is being provided to the inlet of said mass spectrometer;

means for multiplying said second signal by said sixth signal to establish a seventh signal; and means for dividing said fifth signal by said seventh signal to establish an eighth signal representative of the isotope ratio difference (δ) for said reference material and said sample material.

5. Apparatus in accordance with claim 1 wherein said means for moving said first beam blocking means and said means for moving said second beam blocking means are stepping motors.

6. A method for measuring the difference in the concentration of a selected isotope in two materials comprising the steps of:

directing a first molecular beam formed from the vapor associated with a first material, containing said selected isotope, toward the inlet of a mass spectrometer at a time T;

directing a second molecular beam formed from the vapor associated with a second material, containing said selected isotope, toward the inlet of said mass spectrometer at said time T, said first molecular beam and said second molecular beam being passed alternately to the inlet of said mass spectrometer;

initiating the operation of a sequencer means when a sweep period is initiated for said mass spectrometer, said sequencer means automatically controlling means for blocking said first molecular beam and means for blocking said second molecular beam so as to alternately pass or block either said first molecular beam or said second molecular beam or both said first molecular beam and said second molecular beam;

supplying the output signal from said mass spectrometer to a phase sensitive detector means;

establishing a reference signal having a frequency corresponding to the frequency at which said first molecular beam and said second molecular beam are alternately passed to the inlet of said mass spectrometer; and supplying said reference signal to said phase sensitive detector means, said phase sensitive detector means supplying a first signal representative of the difference in the concentration of a selected isotope in said first material and the concentration of said selected isotope in said second material when both said first molecular beam and said second molecular beam are passed alternately to the inlet of said mass spectrometer, said phase sensitive detector means supplying a second signal representative of the concentration of said selected isotope in said first material when only said first molecular beam is being passed to the inlet of said mass spectrometer, said phase sensitive detector means supplying a third signal representative of the concentration of said selected isotope in said second material when said first molecular beam is blocked and only said second molecular beam is being passed to the inlet of said mass spectrometer.

7. A method in accordance with claim 6 wherein said first molecular beam is formed from a reference material having a known concentration of said isotope and said second molecular beam is formed from a sample material having an unknown concentration of said isotope.

8. A method in accordance with claim 7 additionally comprising the step of:

supplying the output of said phase sensitive detector to a data processor means, said sequencer means providing an enabling signal to said data processor means to enable said data processor means to accept data from said phase sensitive detector means when a sweep period is initiated for said mass spectrometer.

9. A method in accordance with claim 7 additionally comprising the steps of:

establishing a fourth signal representative of the gain of said phase sensitive detector means when both said first molecular beam and said second molecular beam and transmitted alternately to the inlet of said mass spectrometer;

multiplying said first signal by said fourth signal to establish a fifth signal;

establishing a sixth signal representative of the gain of said phase sensitive detector means when said second molecular beam is blocked and only said first molecular beam is being provided to the inlet of said mass spectrometer;

multiplying said second signal by said sixth signal to establish a seventh signal; and dividing said fifth signal by said seventh signal to establish an eighth signal representative of the isotope ratio difference (δ) for said reference material and said sample material.

10. A method for determining the isotope ratio difference (δ) between a first material and a second material comprising the steps of:

(a) forming a first molecular beam from the vapors associated with said first material;

(b) forming a second molecular beam from the vapors associated with said second material;

(c) automatically setting a mass spectrometer to a first mass number;

(d) automatically directing said first molecular beam periodically to the inlet of said mass spectrometer;

(e) supporting the output signal from said mass spectrometer to a phase sensitive detector means;

(f) supplying a first reference signal having a frequency corresponding to the frequency at which said first molecular beam is being passed to the inlet of said mass spectrometer, to said phase sensitive detector means, said phase sensitive detector means supplying a first output signal representative of the concentration of an isotope, having said first mass number, in said first material;

(g) automatically setting said mass spectrometer to a second mass number;

(h) automatically directing said first molecular beam and said second molecular beam alternately to the inlet of said mass spectrometer;

(i) supplying the output of said mass spectrometer of said phase sensitive detector means;

(j) supplying a second reference signal, having a frequency corresponding to the frequency at which said first molecular beam and said second molecular beam are alternately passed to the inlet of said mass spectrometer, to said phase sensitive detector means, said phase sensitive detector means supplying a second output signal representative of the difference in the concentration of an isotope, having said second mass number, in said first material and said second material;

(k) automatically setting said mass spectrometer to said first mass number;

(l) automatically directing said second molecular beam periodically to the inlet of said mass spectrometer;

(m) supplying the output of said mass spectrometer to said phase sensitive detector means;

(n) supplying a third reference signal, having a frequency corresponding to the frequency at which said second molecular beam is being passed to the inlet of said mass spectrometer, to said phase sensitive detector means, said phase sensitive detector means supplying a third output signal representative of the concentration of said isotope, having said first mass number, in said second material;

(o) automatically setting said mass spectrometer to said second mass number;

(p) automatically directing said second molecular beam periodically to the inlet of said mass spectrometer;

(q) supplying the output signal from said mass spectrometer to said phase sensitive detector means;

(r) supplying a fourth reference signal having a frequency corresponding to the frequency at which said second molecular beam is being passed to the inlet of said mass spectrometer, to said phase sensitive detector means, said phase sensitive detector means supplying a fourth output signal representative of the concentration of an isotope, having said second mass number, in said second material;

(s) automatically setting said mass spectrometer to said first mass number;

(t) automatically directing said first molecular beam and said second molecular beam alternately to the inlet of said mass spectrometer;

(u) supplying the output of said mass spectrometer to said phase sensitive detector means;

(v) supplying a fifth reference signal, having a frequency corresponding to the frequency at which said first molecular beam and said second molecular beam are alternately passed to the inlet of said mass spectrometer, to said phase sensitive detector means, said phase sensitive detector means supplying a fifth output signal representative of the difference in the concentration of an isotope, having said first mass number, in said first material and said second material;

(w) automatically setting said mass spectrometer to said second mass number;

(x) automatically directing said first molecular beam periodically to the inlet of said mass spectrometer;

(y) supplying the output of said mass spectrometer to said phase sensitive detector means;

(z) supplying a sixth reference signal, having a frequency corresponding to the frequency at which said first molecular beam is being passed to the inlet of said mass spectrometer, to said phase sensitive detector means, said phase sensitive detector means supplying a sixth output signal representative of the concentration of said isotope, having said second mass number, in said first material;

(aa) establishing a seventh signal representative of the gain of said phase sensitive detector means during steps (g)–(j);

(bb) establishing an eighth signal representative of the gain of said phase sensitive detector means during steps (w)–(z);

(cc) multiplying said second output signal by said seventh signal to establish a ninth signal;

(dd) multiplying said sixth outout signal by said eight signal to establish a tenth signal; and (ee) dividing said ninth signal by said tenth signal to establish said isotope ratio difference ($\delta$).

11. A method in accordance with claim 10 wherein steps (c)–(ee) are repeated periodically to obtain a plurality of measurements of said isotope ratio difference ($\delta$).

* * * * *

UNITED STATES PATENT AND TRADEMARK OFFICE

CERTIFICATE OF CORRECTION

PATENT NO. : 4,258,427

DATED : March 24, 1981

INVENTOR(S) : John A. Favre et al

It is certified that error appears in the above-identified patent and that said Letters Patent are hereby corrected as shown below:

Column 8, claim 1, line 27, after "means", delete "supply" and insert --- supplying ---.

Column 10, claim 10, line 44, after "(e)", delete "supporting" and insert --- supplying ---.

line 59, after "spectrometer", delete "of" and insert --- to ---.

Signed and Sealed this

*Twenty-first* Day of *July 1981*

[SEAL]

*Attest:*

GERALD J. MOSSINGHOFF

*Attesting Officer*

*Commissioner of Patents and Trademarks*